United States Patent [19]

Kobayashi

[11] Patent Number: 4,590,989

[45] Date of Patent: May 27, 1986

[54] ELECTROMAGNETIC STIRRER

[75] Inventor: Sumio Kobayashi, Hyogo, Japan

[73] Assignee: Sumitomo Metal Industries, Ltd., Osaka, Japan

[21] Appl. No.: 639,079

[22] Filed: Aug. 9, 1984

[30] Foreign Application Priority Data

Aug. 17, 1983 [JP] Japan ..... 58-150681

[51] Int. Cl.[4] ..... B22D 27/02

[52] U.S. Cl. ..... 164/504; 164/468

[58] Field of Search ..... 164/147.1, 468, 499, 164/504; 266/233, 234; 310/12, 13, 14

[56] References Cited

U.S. PATENT DOCUMENTS 2,513,082 6/1950 Dreyfus ..... 266/234

4,040,467 8/1977 Alberny et al. ..... 164/468

FOREIGN PATENT DOCUMENTS 63072 10/1982 European Pat. Off. ..... 164/504

*Primary Examiner*—Nicholas P. Godici

*Assistant Examiner*—Richard K. Seidel

*Attorney, Agent, or Firm*—Burns, Doane, Swecker and Mathis

[57] ABSTRACT

An electromagnetic stirrer of linear induction motor type for a continuous casting machine, whose coils are arranged to differ a distance between poles of theeven function components of the travelling wave current distribution with respect to the center thereof from that of the odd function components so that a larger electromagnetic force is generated, thereby eliminating the internal defects, such as macro-segregation or center porosity, and improving quality of the ingot. Also, the electromagnetic stirrer, even when attached to a small-sized mold or a mold of small aspect ratio, demonstrates the sufficient effect.

10 Claims, 11 Drawing Figures

ELECTROMAGNETIC STIRRER

BACKGROUND OF THE INVENTION

1. Field of the Invention

This invention relates to an electromagnetic stirrer attached to a continuous casting machine for making the magnetic field act on non-solidified molten steel existing in an ingot cast by the continuous casting machine to progress through the equi-axes crystal zone of the ingot to prevent segregation or the like for eliminating internal defects of the ingot.

2. Description of the Prior Art

Prior art electromagnetic stirrers attached to continuous casting machines act on the non-solidified ingot, i.e., the ingot containing therein non-solidified molten steel, subject the molten steel to a static magnetic field or the travelling magnetic field so that a current induced at the non-solidified portion in the ingot, or a current flowing directly therein, and said magnetic field generate a Lorentz force, by which the non-solidified molten steel is stirred so that a stirring flow breaks crystals during the solidifying process, or a molten steel temperature is equalized to increase the equi-axes crystal zone, thereby preventing macro segregation and eliminating internal defects Such electromagnetic stirrers are of various types according to the size and construction of mold. For example, for a tubular type mold of small section used for a billet continuous casting machine, an electromagnetic stirrer of a rotating field type and of the same construction as a stator of an induction motor is used. However, for a casting machine, such as a bloom continuous casting machine or a slab continuous casting machine, using a built-up mold for an ingot of large section, the electromagnetic stirrer of an induction-motor-type and surrounding the ingot is to large to be practical.

Hence, a stirrer of, a linear induction motor type installed only at the long sides of a mold has been used.

FIG. 1 is a perspective view, exemplary of the above-mentioned stirrer, in which electromagnetic stirrers 10 are assembled with the long sides 2 of a mold 1 (one stirrer only is shown). FIG. 2 is a schematic sectional view taken on the line II—II in FIG. 1, showing an arrangement of a core 20 and coils 40, 41, 42, 43, 44, 45. Into slots 30, 31, 32, 33, 34, 35 and 36 formed at the surface of core 20 opposite to an ingot are fitted six flat coils 40, 41 . . . 44, 45 each having its major diameter horizontal and perpendicular to the axes of slots 30 through 36; the coils 40 to 45 being fitted in longitudinal arrangement and axially juxtaposed in parallel to the widthwise direction, and being arranged downwardly in the order of phases of V, W and U (the order of three phase: U, V and W) in 2 sets, the adjacent coils being contained in the same slots 31, 32, 33 and 34. The current flowing directions are assumed in the order of V, −V, −W, W, U and −U from above.

This coil arrangement provides two sets of coils or a distance between two electrodes only, which is defined on the basis of a design idea based on an infinite length linear induction motor, whose travelling wave current distribution I is given in the following equation (1):

$$I = I_0 \cos(\omega t - kx) \quad (1)$$
$$= I_0 \cos(kx) \cdot \cos \omega t + I_0 \sin(kx) \cdot \sin \omega t$$

-continued $$= \text{Real}\,[I_0 \{\cos(kx) - j \sin(kx)\}\, e^{j\omega t}]$$

where k: $\pi/\tau$ $\tau$: a distance between poles $\omega$: $2\pi f$ f: Frequency of applied AC current $I_o$: Maximum value of travelling wave current t: Time x: Distance from the center of apparatus.

FIG. 3 shows the current components of Equation (1) for seven slots 30 through 36 at the core 20, which each are divided into two perpendicular components assuming that the phase W is 0°; FIG. 3(*a*) showing the W-phase component and FIG. 3(*b*) the component perpendicular thereto.

In such a coil arrangement and energization, the magnetic flux, for example a U-phase current, as shown by the broken line in FIG. 2, perforates magnetic poles (core portions) formed between the slots 32 and 33 and the slots 35 and 36 containing the U-phase coils 42 and 45. Accordingly, currents flowing in U-phase coils 42 and 45 are restricted by the saturation magnetic flux density defined by a sectional area or a width c, thereby creating a problem in that an electromagnetic force or a molten steel stirring force is not sufficiently obtained.

In a case of using a bloom continuous casting machine for an ingot of sectional area of 300×400 mm$^2$; assuming that a mold thickness is 30 mm, a length ($2\tau$) of a linear induction motor is 500 mm or less, and a distance between the front of linear induction motor and the molten steel is 120 mm; an electromagnetic force of 5000 N/m$^3$ is required to sufficiently stir the molten steel. However, only 2000 N/m$^3$ is obtained from computation of the electromagnetic field using the finite element method and the magnetic field measurement by a 1/10 model.

Hence, it is proposed to use a short pitch winding of length $2\tau$ and divided into three equal parts as shown in FIG. 4. In this case, sicne the coil number is a half, the sectional area or width of the magnetic pole becomes twofold. Such construction cannot obtain a sufficient electromagnetic force because it is less affected by the magnetic saturation, but an electromagnetic force of 3000 N/m$^3$ is obtainable under the aforesaid conditions.

OBJECT OF THE INVENTION

In the light of the above problems, this invention has been designed. A first object of the invention is to provide an electromagnetic stirrer which is capable of obtaining a larger electromagnetic force in comparison with the conventional stirrer, thereby improving the quality of a continuously cast ingot.

A second object of the invention is to provide a small-sized stirrer attachable to a small-sized mold and capable of obtaining a sufficient electromagnetic force.

A third object of the invention is to provide an electromagnetic stirrer which is capable of obtaining a sufficient electromagnetic force even when attached to a mold formed smaller in an aspect ratio, in other words, about square in cross section.

The above and further objects and features of the invention will more fully be apparent from the following detailed description with accompanying drawings.

DETAILED DESCRIPTION OF THE INVENTION

Figure 1:
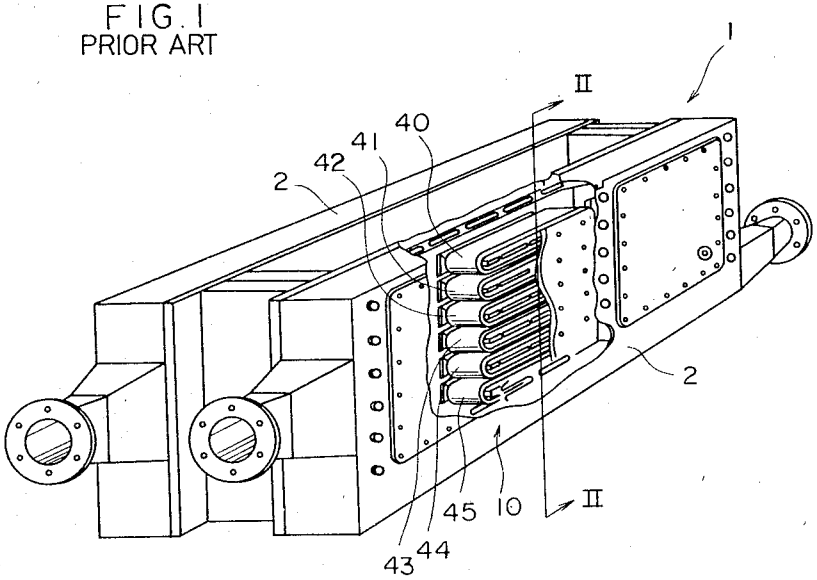
FIG. 1 PRIOR ART
FIG. 1 is a perspective structural view of a conventional electromagnetic stirrer.
Figure 5:
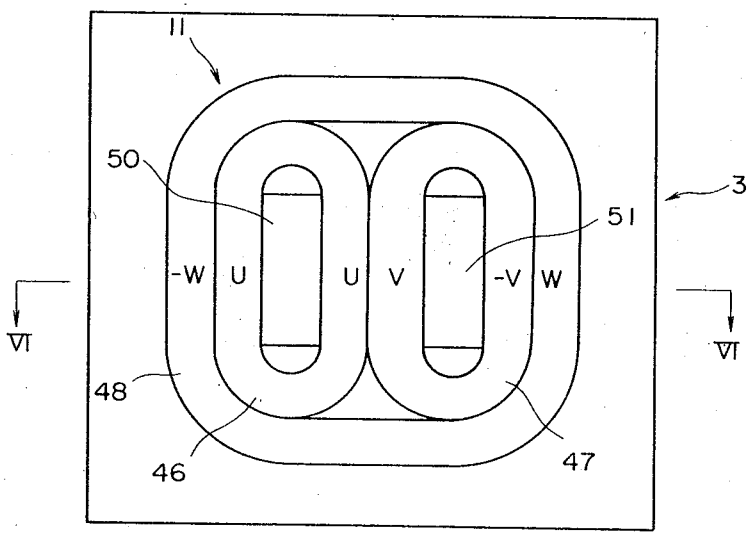
FIG. 5 is a cross-sectional view of an embodiment of the electromagnetic stirrer of the invention.

The invention is herein described with reference to the drawings. FIG. 5 is a schematic side view of an electromagnetic stirrer 11 shown together with a mold 3, and FIG. 6 is partially sectional plan view taken on the line VI—VI in FIG. 5, in which coils 46, 47 and 48 are different in the lateral juxtaposition direction from those in FIG. 1 so that molten steel A is stirred circumferentially of mold 3 as shown by the arrow, where the coils 46, 47 and 48 may be longitudinally juxtaposed in the manner of the coils of FIG. 1.

Figure 6:
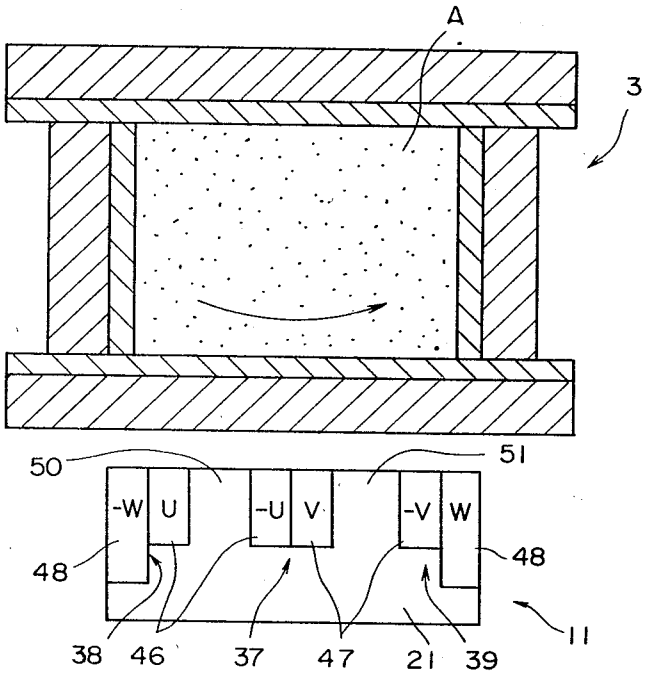
FIG. 6 is a sectional plan view thereof.

The electromagnetic stirrer of the invention, as shown in the sectional view in FIG. 6, is characterized in arrangement of coils 46, 47 and 48. In detail, a core 21 is provided at the lengthwise central portion with a center slot 37 and at both lengthwise ends with end slots 38 and 39 cut out therefrom. Magnetic poles 50 and 51 are formed between the slots 37 and 38 and between the slots 37 and 39. U-phase coil 46 is contained in the slots 37 and 38 and around the magnetic pole 50, V-phase coil 47 is contained in the slots 37 and 39 and around the magnetic pole 51, and W-phase coil is contained in the slots 38 and 39 and surrounding the U-phase coil 46 and V-phase coil 47. The current phases of U-phase coil 46 and V-phase coil 47 are asymmetrical with respect to the center of this apparatus and the W-phase coils 48 are so defined that coils of phases U and −W and those −V and W are positioned at the same slots 38 and 39 respectively as shown in FIG. 6.

In addition, the W-phase coils 48 are larger in axial size than the U-phase coils 46 and V-phase coils 47, so that the slots containing these coils are made deeper, which provides an improvement in the formation of travelling wave curent distribution.

The travelling wave current distribution in such coil arrangements and current phases is as follows. Now, the phase W is represented by 0, the current distribution of each phase $I_U$, $I_V$ and $I_W$ is given in the following equation:

$$I_U = I_0 \cos(2\pi ft - 120°) \quad (2)$$
$$= I_0 \cos(2\pi ft - \tfrac{2}{3}\pi)$$
$$I_V = I_0 \cos(2\pi ft + 120°) \quad (3)$$

-continued $$= I_0 \cos(2\pi ft + \tfrac{2}{3}\pi)$$

$$I_W = I_o \cos(2\pi ft) \quad \ldots (4)$$

Accordingly, the following equations are obtained:

$$I_U = I_0\cos(2\pi ft)\cos(\tfrac{2}{3}\pi) + I_0\sin(2\pi ft)\sin(\tfrac{2}{3}\pi) \quad (5)$$
$$= -I_0/2\cos(2\pi ft) + \sqrt{3}/2\, I_0\sin(2\pi ft)$$
$$I_V = I_0\cos(2\pi ft)\cos(\tfrac{2}{3}\pi) - I_0\sin(2\pi ft)\sin(\tfrac{2}{3}\pi) \quad (6)$$
$$= -I_0/2\cos(2\pi ft) - \sqrt{3}/2\, I_0\sin(2\pi ft)$$

Now, regarding each slot 37, 38 or 39, the current distribution in slot 38 is given in the following equation:

$$I_U - I_W = I_0\cos(2\pi ft - \tfrac{2}{3}\pi) - I_0\cos(2\pi ft)$$
$$= -2\, I_0\sin(2\pi ft - \tfrac{1}{3}\pi)\cdot\sin(-\tfrac{1}{3}\pi)$$
$$= \sqrt{3}\, I_0\sin(2\pi ft - \tfrac{1}{3}\pi)$$
$$= \sqrt{3}/2\, I_0[\sin(2\pi ft) - \sqrt{3}\cos(2\pi ft)].$$

That in the slot 37 is given in:

$$I_V - I_U = I_0\cos(2\pi ft + \tfrac{2}{3}\pi) - I_0\cos(2\pi ft - \tfrac{2}{3}\pi)$$
$$= -2\, I_0\sin(2\pi ft)\cdot\sin(\tfrac{2}{3}\pi)$$
$$= -\sqrt{3}\, I_0\sin(2\pi ft)$$

That in the slot 39 is given in:

$$I_W - I_V = I_0\cos(2\pi ft) - I_0\cos(2\pi ft + \tfrac{2}{3}\pi)$$
$$= -2\, I_0\sin(2\pi ft + \tfrac{1}{3}\pi)\cdot\sin(-\tfrac{1}{3}\pi)$$
$$= \sqrt{3}\, I_0\sin(2\pi ft + \tfrac{1}{3}\pi)$$
$$= \sqrt{3}/2\, I_0[\sin(2\pi ft) + \sqrt{3}\cos(2\pi ft)]$$

Figure 7:
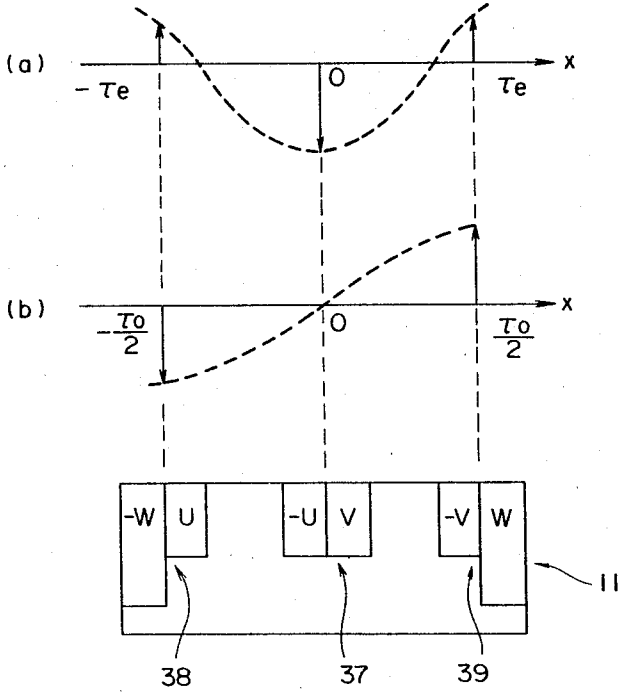
FIG. 7 is a graph showing the relation between the position of each slot and the current component corresponding thereto.

FIG. 7 shows the component perpendicular to the phase W, that is, the component related to sin ($2\pi$ft) perpendicular to cos ($2\pi$ft), at the upper side (a) and the component of phase W [component of cos ($2\pi$ft)] at the lower side (b) on the bases of the results of the above computations. As seen from the both the distributions, in the odd function component [W-phase component shown in FIG. 7(*b*)] with respect to the center of the apparatus of the invention, a distance between the end slots 38 and 39 corresponds to a distance $\tau_o$ between the poles, while, in the even function component [the component perpendicular to the phase W in FIG. 7(*a*)] with respect to the center of the apparatus, a distance between the end slot 38 and the center slot 37 and that between the end slot 39 and the center slot 37 are a distance $\tau_e$ between the poles respectively and smaller than the distance between the end slots 38 and 39, that is, the distance $\tau_o$ between the poles.

Figure 8:
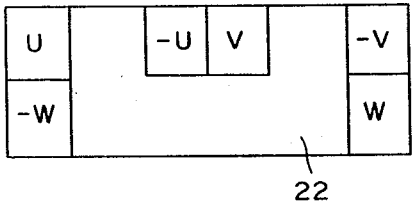
FIGS. 8, 9 and 10 are illustrations of arrangements of cores and coils in modified embodiments of the invention.
Figure 9:
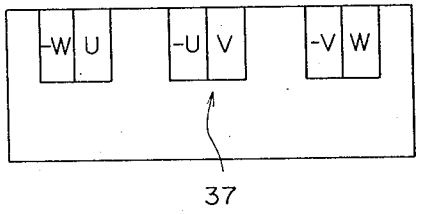

In such construction, the measurement by the computation and 1/10 model, as heretofore mentioned could obtain an electromagnetic force of 5600 N/m$^3$. The same effect is obtained by the coil arrangements and current phases relative thereto shown in FIGS. 8, 9 and 10. Constructions shown in FIGS. 8 and 9 are basically the same as those in FIGS. 5 and 6. In detail, in FIG. 8, no end slot is provided, but at both ends of core 22 are disposed one side of V-phase coil and W-phase coil. In FIG. 9, the end slots are formed in complete grooves as the same as the central slot 37.

Figure 10:
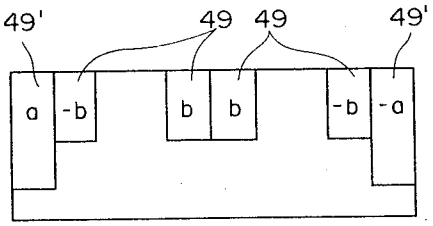

Also, in FIG. 10, a 2-phase AC of phases a and b is used in place of the 3-phase AC, two b-phase coils 49 are disposed at the center and two a-phase coils 49' surround the b-phase coils 49. Distributions of current Ia of a-phase and Ib of b-phase are $Ia=-I_o \sin(2\pi ft)$ when it is assumed that $Ib=I_o \cos(2\pi ft)$, whereby Ia and Ib become the components perpendicular to each other and the travelling wave current distributions are the same as those shown in FIGS. 7(*a*) and (*b*), in which also the even function component (b-phase component) with respect to the center of the apparatus and the odd function component (a-phase component) are different in a distance between poles from each other.

These constructions and excitation phases are common in that a width between the respective slots is made larger; in other words, the sectional area of magnetic pole is made larger to reduce the influence of magnetic saturation, and the even function component and odd function component of the travelling wave current distribution with respect to the center of the apparatus are different distances between poles.

Figure 2:
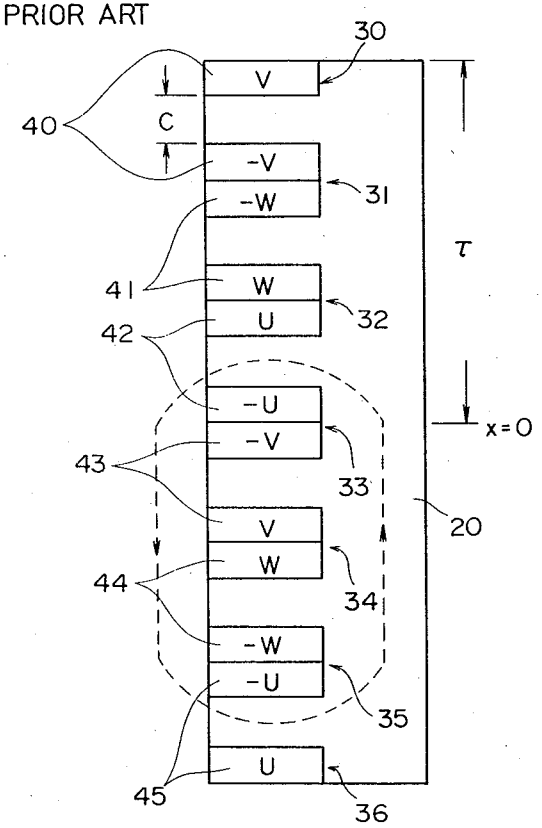
FIG. 2 PRIOR ART
FIG. 2 is a sectional view taken on the line II—II in FIG. 1, showing arrangement of a cores and coils in the conventional stirrer.
Figure 4:
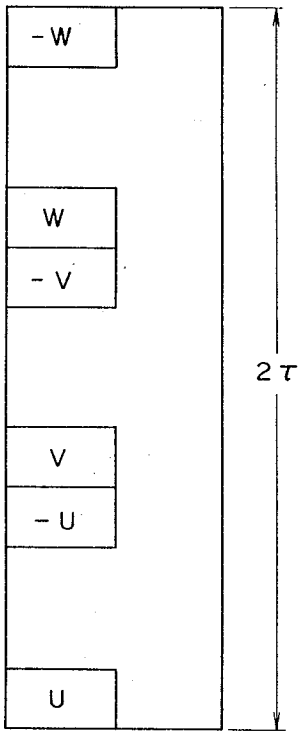
FIG. 4 PRIOR ART
FIG. 4 is a view exemplary of an improvement in the conventional electromagnetic stirrer.
Figure 3:
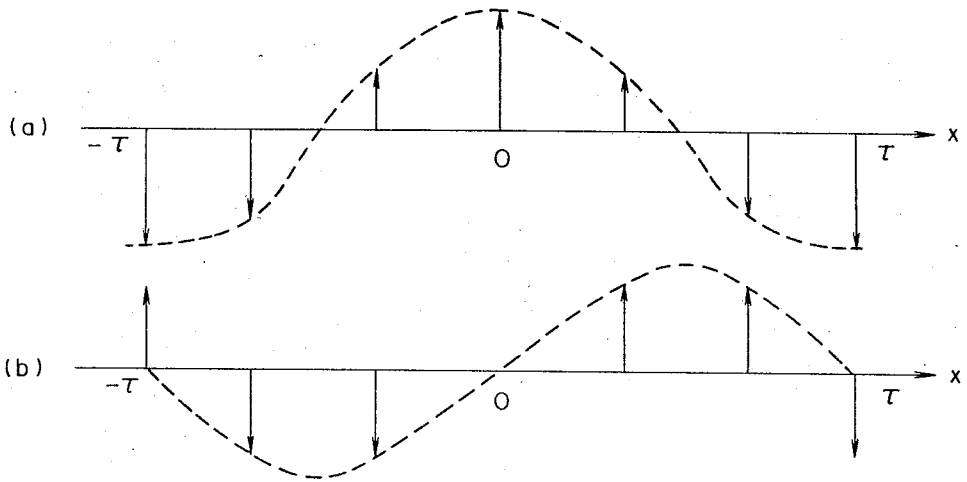
FIG. 3 PRIOR ART
FIG. 3 is a graph showing the current components thereof.

When the construction of the invention in FIG. 4 is compared with that of conventional stirrer in FIG. 2, the former can enlarge the magnetic pole width (sectional area of magnetic pole), thereby making it possible to reduce the influence of magnetic saturation as much as possible.

Also, in a case where the length of a linear motor is made constant, the distance $\tau_o$ between poles of the odd function component of the apparatus of the invention can be about twice the conventional apparatus shown in FIG. 2, so that the larger the distance between poles becomes, the smaller the magnetic attenuation for the linear motor is. Hence, the electromagnetic stirrer of the invention enables the magnetic field to act effectively in the molds.

Figure 11:
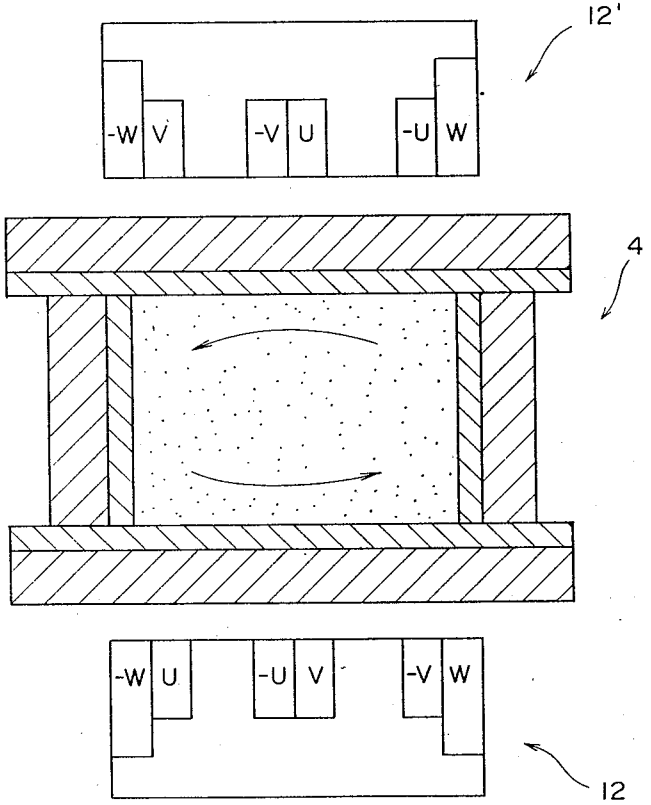
FIG. 11 is a schematic view of the modified embodiment of the invention.

A modified embodiment of the invention is shown in FIG. 11. In this embodiment, electromagnetic stirrer units 12 and 12' of the same core construction and coil arrangement as the stirrer 11 shown in FIGS. 5 and 6 are disposed opposite to both of the long sides of a mold 4 respectively. The electromagnetic stirrer unit 12 at one side has the same phase of current flowing therein as that shown in FIGS. 5 and 6, but the unit 12' at the other side is different in the exciting phase. In detail, assuming that the stirring flow is counterclockwise as shown in FIG. 11, while one electromagnetic stirrer unit 12 disposes the coils of phases <W, U, −U, V, −V and W in the order in the direction of flow, the other unit 12', in the order of W, −U, U, −V, V and −W. In other words, the units 12 and 12' are energized such that the W-phases (odd function components) are in-phase and the U and V-phases (even function components) are opposite-phase.

In order to get the stirring flows of both side of the electromagnetic stirrer unit 12 and 12' in the same direction, it is considered that the exciting phase need only be centrally symmetrical with respect to the electromagnetic stirrer units 12 and 12' and mold 4. However, with such energization, that is, energization for the odd function components opposite-phase and even function components in-phase, it is impossible to obtain sufficient stirring flow. On the contrary, the energization as shown in FIG. 11, when carried out, has obtained a high flow velocity of 0.47 m/sec (measured by the dendrite deflection angle).

Incidentally, the electromagnetic stirrer of the invention is of small-size and of high electromagnetic force, which of course is applicable to all kinds of continuous casting machines, as well as the bloom continuous casting machine.

As this invention may be embodied in several forms without departing from the spirit of the essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. In a continuous casting machine, on electromagnetic stirrer, said stirrer being of the type of a linear induction motor, comprising:

an elongated core having a center, sides and ends;

at least one slot formed in one side of said core and located adjacent the center of the core;

first and second poles on opposite sides of said slot;

first coil means for generating even function components of travelling wave current distribution including first and second coils wound, respectively, around said first and second poles and each having a winding portion adjacent an end of said core and a winding portion disposed in said at least one slot; and an additional coil means for generating odd function components of travelling wave current distribution including a third coil having coil portions adjacent opposite ends of said core;

the distance between the coil portions of said third coil adjacent opposite ends of said core being approximately twice as great as the distance between the winding portion adjacent said end and the winding portion in said slot of each of said first and second coils.

2. An electromagnetic stirrer as set forth in claim 1, wherein:

three slots are formed in said core, one of the slots being said at least one slot adjacent said core center and the other two slots being located at opposite ends of the core;

the respective portions of said first and second coils adjacent opposite ends of said core being located in one of the other two slots; and wherein the first, second and third coils are disposed to be fed a three-phase alternate current.

3. An electromagnetic stirrer as set forth in claim 1, wherein:

said portions of said first, second and third coils adjacent opposite ends of said core are on the ends of said core.

4. An electromagnetic stirrer as set forth in claim 3, wherein:

said first and second coils are disposed to be fed one phase of a two-phase alternate current; and said third coil is disposed to be fed the other phase of a two-phase alternate current.

5. An electromagnetic stirrer as set forth in claim 1, wherein:

additional slots are formed adjacent to and spaced from said opposite ends of said core; and said portions of said first, second and third coils adjacent opposite ends of said core are disposed in said additional slots.

6. A continuous casting machine having first and second electromagnetic stirrers located on opposite sides thereof, each stirrer comprising:

an elongated core having a center, sides and ends;

at least one slot formed in one side of said core and located adjacent the center of the core;

first and second poles on opposite sides of said slot;

first coil means for generating even function components of travelling wave current distribution including first and second coils wound, respectively, around said first and second poles and each having a winding portion adjacent an end of said core and a winding position disposed in said at least one slot; and an additional coil means for generating odd function components of travelling wave current distribution including a third coil having coil portions adjacent opposite ends of said core;

the distance between the coil portions of said third coil adjacent opposite ends of said core being approximately twice as great as the distance between the winding portion adjacent said end and the winding portion in said slot of each of said first and second coils;

wherein the polarities of said even function components of said first stirrer are opposite to the polarities of said even function components of said second stirrer and the polarities of the odd function components are the same on each stirrer.

7. A continuous casting machine as set forth in claim 6, wherein each stirrer unit includes:

three slots formed in said core, one of the slots being said at least one slot adjacent said core center and the other two slots being located at opposite ends of the core;

the respective portions of said first and second coils adjacent opposite ends of said core being located in one of the other two slots; and wherein the first, second and third coils are disposed to be fed a three-phase alternate current.

8. A continuous casting machine as set forth in claim 6, wherein each stirrer unit includes:

said portions of said first, second and third coils adjacent opposite ends of said core are on the ends of said core.

9. A continuous casting machine as set forth in claim 8, wherein each stirrer unit includes:

said first and second coils are disposed to be fed one phase of a two-phase alternate current; and said third coil is disposed to be fed the other phase of a two-phase alternate current.

10. A continuous casting machine as set forth in claim 6, wherein each stirrer unit includes:

additional slots formed adjacent to and spaced from said opposite ends of said core; and said portions of said first, second and third coils adjacent opposite ends of said core are disposed in said additional slots.

* * * * *